United States Patent [19]

Lippmann et al.

[11] Patent Number: 4,970,441

[45] Date of Patent: Nov. 13, 1990

[54] BRIGHTNESS STABILIZING CONTROL OF A VF DISPLAY

[75] Inventors: Raymond Lippmann, Ann Arbor; Michael J. Schnars, Clarkston; James E. Nelson, Union Lake, all of Mich.

[73] Assignee: Delco Electronics Corporation, Kokomo, Ind.

[21] Appl. No.: 389,445

[22] Filed: Aug. 4, 1989

[51] Int. Cl.[5] ..... H05B 41/00; G09G 3/04

[52] U.S. Cl. ..... 315/337; 315/168; 315/169.3; 315/DIG. 1; 340/767

[58] Field of Search ..... 315/167, 168, 169.1, 315/169.3, 291, 307, 334, 337, 339, 349, DIG. 1, DIG. 4, DIG. 7; 340/767

[56] References Cited

U.S. PATENT DOCUMENTS 4,241,294 12/1980 Fisler ..... 315/291
4,495,445 1/1985 Turney ..... 315/169.1
4,922,243 5/1990 Kosicki et al. ..... 315/169.1 X

OTHER PUBLICATIONS

Brochure Entitled "Fluorescent Indicator Panel Application Notes" NEC Electronics Inc., Issue 2.

*Primary Examiner*—David Mis
*Attorney, Agent, or Firm*—Mark A. Navarre

[57] ABSTRACT

A VF display control apparatus operated directly from an automotive storage battery in which the display brightness variation is minimized by controlling the relationship between the anode and grid voltages in relation to the fluctuation of the battery voltage. The anodes of the display are operated substantially at the battery voltage, and the grid voltage is reduced in relation to the amount by which the anode (supply) voltage exceeds the nominal open-circuit terminal voltage of the battery.

9 Claims, 2 Drawing Sheets

BRIGHTNESS STABILIZING CONTROL OF A VF DISPLAY

This invention relates to the control of an automotive vacuum fluorescent (VF) display, and more particularly, to a method and apparatus for minimizing the display brightness variations which occur due to variations in the supply voltage.

BACKGROUND OF THE INVENTION

Vacuum fluorescent (VF) displays are generally defined by an evacuated envelope enclosing one or more phosphored anodes arranged in a pattern of desired light emission, a filament and a grid disposed between the anodes and filament. The filament is electrically heated at a relatively low voltage to generate a cloud of electrons, and the grid is maintained at a relatively high voltage to accelerate electrons onto any of the anodes which are also maintained at a relatively high voltage. The anodes bombarded by electrons emit light due to the phosphor coating.

In automotive applications, the anodes, filament and grid are generally referenced to the storage battery, as shown in the PRIOR ART drawing of FIG. 1. Referring to FIG. 1, the storage battery 10 is connected by ignition switch 12 to a supply terminal T which, when referenced to the vehicle frame, is generally referred to as the ignition voltage or IGN. The VF display is generally designated by the reference numeral 14 and comprises a filament 16, a grid 18 and a plurality of anode segments 20. The anode segments 20 are individually and selectively connected to the ignition voltage IGN through an anode driver array 22 and a dimming circuit 24. The anode driver array 22 and a dimming circuit 24. The anode driver array comprises a plurality of solid state switches 26 which are individually controlled to define the pattern of desired light emission, and the dimming circuit 24 comprises a solid state switch 28 which is pulse-width-modulated to control the average anode voltage and therefore the overall brightness of the display 14. A control of this sort is generally required for operator adjustment of the display brightness in night driving conditions. The grid 18 is maintained substantially at the ignition voltage IGN through the resistor $R_g$ and the filament is energized at a relatively low potential via a dropping resistor $R_f$ or a separate low voltage power supply (not shown). When multiplexing is employed, a grid supply switch 30 may be provided for open-circuiting the grid 18 to turn off the entire portion of the display 14 situated under the grid.

A drawback of the above-described drive circuit is that the display brightness tends to vary with the terminal voltage of the battery 10. In certain displays, brightness variations of 60% or more have been observed when the battery voltage is allowed to fluctuate over a 12–16 volt range. The usual solution is to insert a regulated power supply between the battery and the display. This, of course, is quite expensive, especially if a switching regulator is required.

SUMMARY OF THE PRESENT INVENTION

The present invention is directed to an improved VF display control apparatus operated directly from an automotive storage battery, wherein the display brightness variation is minimized by controlling the relationship between the anode and grid voltages in relation to the fluctuation of the battery voltage. In essence, we have discovered that the brightness fluctuations of a VF display can be reduced or substantially eliminated over a range of supply voltages by driving the anode and grid such that the grid voltage varies in inverse relation to that of the anode voltage.

In operation, the anode and filament voltages are ratiometrically related to the battery voltage, and the grid is supplied with an independently variable voltage intermediate that of the anode and filament. In the illustrated embodiment, the anodes of the display are operated substantially at the battery voltage, and the voltage supplied to the grid is reduced in relation to the amount by which the anode (supply) voltage exceeds the nominal open-circuit terminal voltage of the battery. The voltage increase at the filament is relatively slight compared to the voltage increase at the anode, and the reduced grid voltage compensates for the higher anode-to-filament potential difference by reducing the grid-to-filament potential difference. As a result, the anode is bombarded by fewer but more energetic electrons and the display brightness tends to remain relatively constant. In a mechanization of the illustrated embodiment, the overall display brightness variation over a supply voltage range of 12–16 volts was reduced to less than 10%.

DETAILED DESCRIPTION OF THE DRAWINGS

Figure 1:
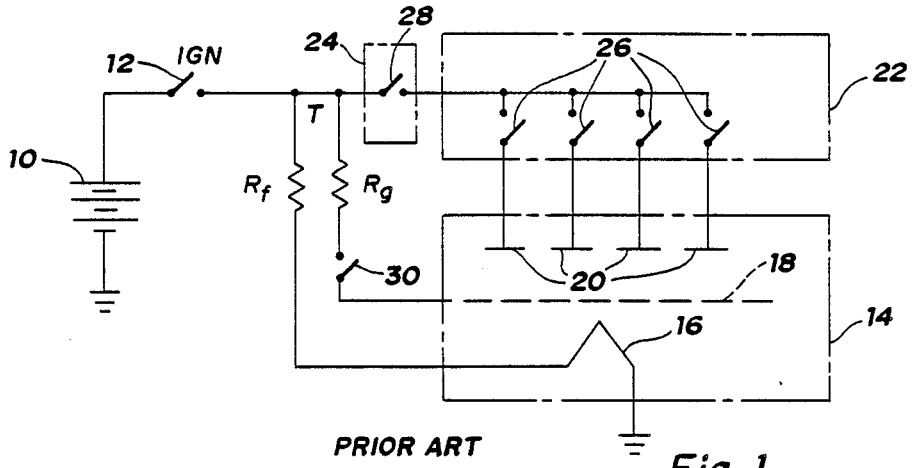
FIG. 1 is a circuit diagram of a prior art control circuit for a VF display.
Figure 2:
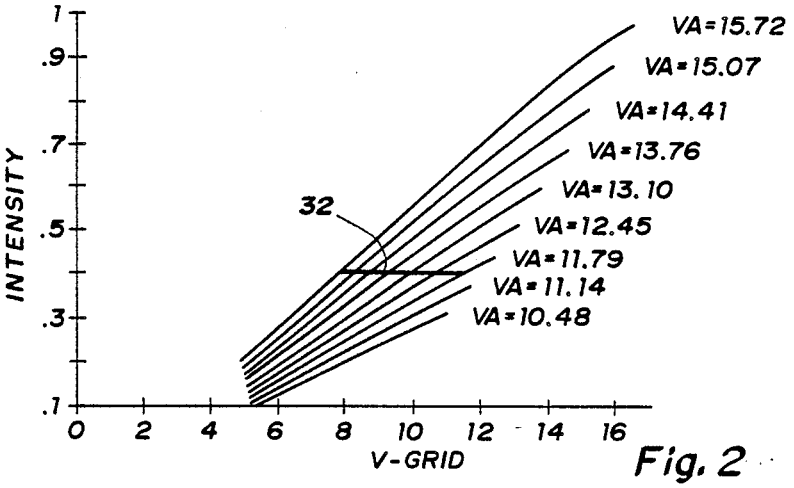
FIG. 2 is a graph depicting the intensity of a VF display as a function of the grid voltage for various anode voltages within the normal range of automotive battery voltage fluctuation.

As indicated above, the prior control circuit of FIG. 1 exhibits significant display brightness variation due to supply voltage variations. The characteristic graphs of FIG. 2 were generated as part of an analysis of this phenomenon. Referring to FIG. 2, the intensity or brightness of a given VF display is plotted as a function of grid voltage for various anode voltage values within the normal range of fluctuation of automotive ignition voltage, the filament voltage being maintained substantially constant. In the conventional display drive circuit of FIG. 1, the grid voltage generally follows the anode (ignition) voltage resulting in the indicated brightness fluctuations.

Figure 3:
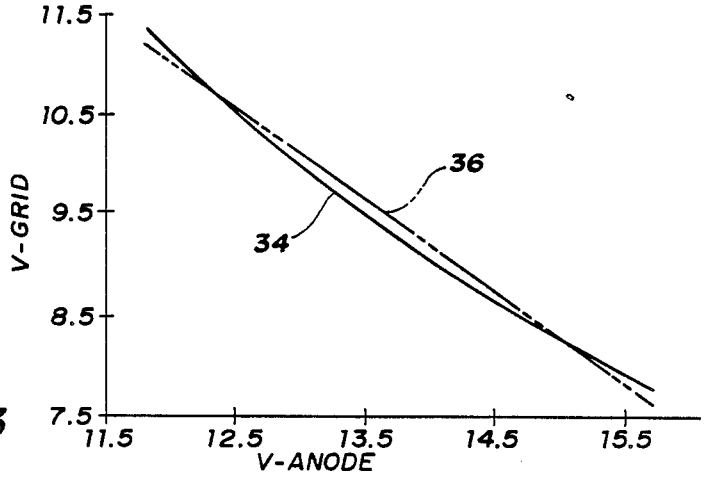
FIG. 3 is a graph depicting the grid voltage vs. anode voltage required to maintain the brightness of the VF display of FIG. 2 substantially constant over a range of battery voltages.

However, this invention recognizes that the display brightness can be maintained substantially constant over a range of ignition voltages by controlling the relation between the anode and grid voltages along a given constant brightness load line, as represented by the trace 32 in FIG. 2. The relation between the anode and grid voltages for the brightness represented by the trace 32 is depicted by the trace 34 of FIG. 3. Various traces similar to the trace 34 can be developed for any value of constant brightness depicted in FIG. 2. Significantly, such traces define an inverse relation between the anode and grid voltages.

Figure 4:
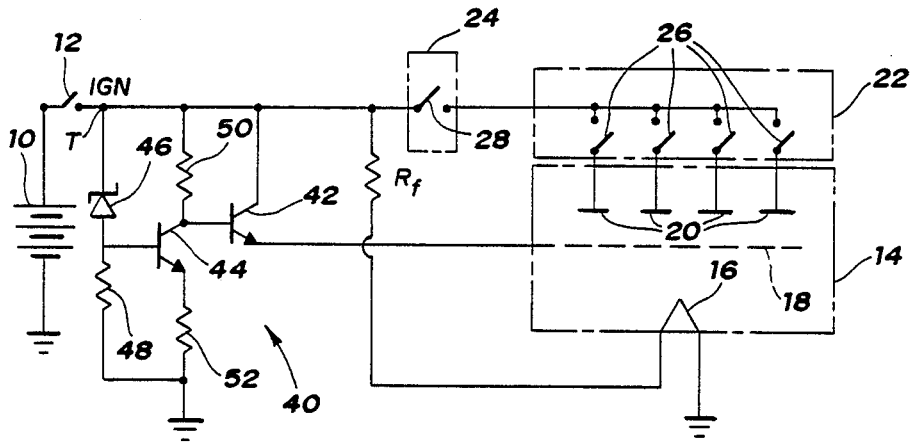
FIG. 4 is a circuit for mechanizing the relationship depicted in the graph of FIG. 3.
Figure 5:
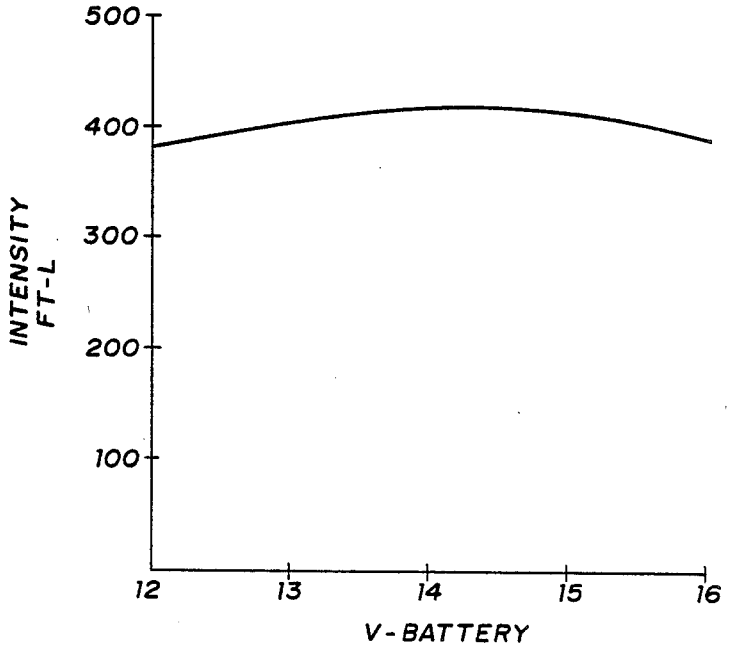
FIG. 5 is a graph depicting the performance of the circuit of FIG. 3 in terms of measured display brightness over the supply voltage range of 12–16 volts.

The constant intensity relationship described above in reference to the traces 32 and 34 can be approximated with the grid drive circuit of FIG. 4 to produce the brightness performance depicted in FIG. 5. Referring to FIG. 4, elements corresponding to those depicted in FIG. 1 have been assigned the same reference numerals. Thus, the exciting current for filament 16 is supplied from the ignition voltage IGN via dropping resistor $R_f$, and the anodes 20 are selectively connected to the ignition voltage IGN via the anode driver array 22 and the dimming circuit 24. However, the grid voltage is now controlled by the grid drive circuit designated generally by the reference numeral 40.

The grid drive circuit 40 comprises a first transistor 42 connecting the ignition voltage IGN to the display grid 18 and a second transistor 44 for limiting the conduction of transistor 42 when the ignition voltage IGN (and hence, the anode voltage) rises above a reference voltage $V_z$ defined by the Zener diode 46. So long as the ignition voltage is less than or equal to the Zener voltage $V_z$, the transistor 44 is maintained in a nonconductive state by the pulldown resistor 48, and the transistor 42 is maintained in a fully conductive state by the pullup resistor 50. In this state, the potential of grid 18 is maintained approximately one diode drop below the ignition (anode) voltage IGN.

When the ignition voltage rises above the Zener voltage $V_z$, the transistor 44 begins to conduct, diverting some of the base current of transistor 42 to ground through the resistor 52. This causes transistor 42 to operate in its linear region which increases the voltage drop across its collector-emitter circuit and correspondingly decreases the voltage applied to the grid 18 according to the relationship defined by the broken trace 36 of FIG. 3.

In the conventional circuit of FIG. 1, increases in the supply (anode) voltage produce similar increases grid-to-filament voltage since the corresponding increase in the filament voltage is relatively slight. This increases both electron flow and the energy level of the electrons at the anode and therefore increases the brightness of the emitted light. With the control of this invention, however, increases in the anode voltage are accompanied by decreases in the grid voltage, thereby reducing the grid-to-filament voltage. As a result, the anode is bombarded by fewer, more energetic electrons and the display brightness tends to remain relatively constant, as graphically depicted in FIG. 5, where the measured display brightness or intensity in FT-L is given as a function of the ignition voltage IGN. As seen in the graph, the intensity variation is less than 10% over an ignition voltage range of 12–16 volts, the range one would normally experience in the operation of a motor vehicle.

While this invention has been described in reference to the illustrated embodiment, it will be recognized that various modifications will occur to those skilled in the art. In the illustrated embodiment, the nominal open-circuit terminal voltage of the storage battery is chosen as a baseline operating point, above which the grid voltage is made to decrease with increasing anode voltage. However, the primary import of the present invention is that the brightness fluctuations of a VF display can be reduced or substantially eliminated over a range of supply voltages by driving the anode and grid such that the grid voltage varies in inverse relation to that of the anode voltage. Thus, it will be understood that the scope of this invention is broader than the illustrated embodiment and is only limited by the appended claims.

The embodiments of the invention in which an exclusive property or privilege is claimed are defined as follows:

1. In a display system including a vacuum fluorescent tube in which electrons generated at a filament element and attracted by a grid element bombard a phosphored anode element to emit light for display purposes, and control apparatus for supplying operating voltages to the filament, grid and anode elements from a variable voltage source, the improvement wherein:

the voltage supplied to the anode element follows the voltage of said source; and the voltage supplied to the grid element is varied in inverse relation to that of the voltage supplied to the anode element, thereby to reduce fluctuations in the brightness of the emitted light despite substantial variation of the source voltage.

2. In a display system including a vacuum fluorescent tube in which electrons generated at a filament element and attracted by a grid element bombard a phosphored anode element to emit light for display purposes, and control apparatus for supplying operating voltages to the filament, grid and anode elements from a source having a variable output voltage, the improvement wherein:

the anode element is operated substantially at the output voltage of said source; and the grid is operated at a voltage lower than the output voltage of said source and which varies in inverse relation thereto, at least when said output voltage exceeds a reference voltage.

3. The improvement of claim 2, wherein:

the source includes an automotive storage battery having a nominal open-circuit output voltage, the battery being adapted to be charged at voltages in excess of such nominal open-circuit voltage; and the reference voltage substantially corresponds to said nominal open-circuit voltage.

4. In a display system including a vacuum fluorescent tube in which electrons generated at a filament element and attracted by a grid element bombard a phosphored anode element to emit light for display purposes, control apparatus for supplying operating voltages to the filament, grid and anode elements from a source having a variable output voltage so as to minimize source voltage related variations in the brightness of the emitted light, comprising:

anode supply means connected between the source and the anode element for supplying an operating voltage to the anode element which follows the output voltage of said source; and grid supply means connected between the source and the grid element for supplying the grid element with an operating voltage which varies in inverse relation to the voltage supplied to the anode element.

5. In a display system including a vacuum fluorescent tube in which electrons generated at a filament element and attracted by a grid element bombard a phosphored anode element to emit light for display purposes, control apparatus for supplying operating voltages to the filament, grid and anode elements from a source having a variable output voltage so as to minimize source voltage related variations in the brightness of the emitted light, comprising:

anode supply means connected between the source and the anode element for supplying an operating voltage to the anode element which is substantially equal to the output voltage of said source; and grid supply means connected between the source and the grid element for supplying the grid element with an operating voltage which is lower than the voltage supplied to said anode element and which varies in inverse relation thereto, at least when said output voltage exceeds a reference voltage.

6. The apparatus set forth in claim 5, wherein:

the source includes an automotive storage battery having a nominal open-circuit output voltage, the battery being adapted to be charged at voltages in excess of such nominal open-circuit voltage; and the reference voltage substantially corresponds to said nominal open-circuit voltage.

7. In a display system including a vacuum fluorescent tube in which electrons generated at a filament element and attracted by a grid element bombard a phosphored anode element to emit light for display purposes, control apparatus for supplying operating voltages to the filament, grid and anode elements from a source having a variable output voltage so as to minimize source voltage related variations in the brightness of the emitted light, comprising:

anode supply means connected between the source and the anode element for supplying the anode element with an operating voltage substantially equal to the output voltage of said source;

filament supply means connected between the source and the filament element for supplying the filament element with a relatively low operating voltage ratiometrically related to the output voltage of said source;

grid supply means connected between the source and the grid element for supplying the grid element with an operating voltage intermediate the operating voltages supplied to said anode and filament elements, at least when said output voltage is less than a reference voltage; and brightness control means for reducing the operating voltage supplied to the grid element by said grid supply means in relation to the amount by which the operating voltage supplied to the anode element exceeds said reference voltage.

8. The apparatus set forth in claim 7, wherein:

the source includes an automotive storage battery having a nominal open-circuit output voltage, the battery being adapted to be charged at voltages in excess of such nominal open-circuit voltage; and the reference voltage substantially corresponds to said nominal open-circuit voltage.

9. In a display system including a vacuum fluorescent tube in which electrons generated at a filament element and attracted by a grid element bombard a phosphored anode element to emit light for display purposes, control apparatus for supplying operating voltages to the filament, grid and anode elements from a source having a variable output voltage so as to minimize source voltage related variations in the brightness of the emitted light, comprising:

ratiometric supply means connecting the source to the anode and filament elements for supplying the anode and filament elements with relatively high and low operating voltages, respectively, which ratiometrically follow the output voltage of said source; and grid supply means connected between the source and the grid element for supplying the grid element with an independently variable operating voltage intermediate the operating voltages of said anode and filament elements such that increases in the anode voltage are accompanied by decreases in the grid voltage to effect a lower voltage difference between the filament and grid elements, whereby the anode is bombarded by fewer electrons and the brightness of the emitted light tends to remain relatively constant.

* * * * *